United States Patent [19]

Walker

[11] 3,998,047

[45] Dec. 21, 1976

[54] METHOD AND APPARATUS FOR PREVENTING OVERSPEED IN A GAS TURBINE

[75] Inventor: William E. Walker, San Diego, Calif.

[73] Assignee: The United States of America as represented by the United States Energy Research and Development Administration, Washington, D.C.

[22] Filed: Apr. 18, 1975

[21] Appl. No.: 569,351

[52] U.S. Cl. ..... 60/39.03; 60/39.23; 60/39.25; 60/39.29

[51] Int. Cl.[2] ..... F02C 9/14

[58] Field of Search ..... 60/39.29, 39.27, 39.23, 60/39.25, 39.03

[56] References Cited

UNITED STATES PATENTS

| | | | |
|---|---|---|---|
| 2,759,327 | 8/1956 | Huber | 60/39.25 X |
| 3,037,348 | 6/1962 | Gassmann | 60/39.29 X |
| 3,070,131 | 12/1962 | Wheatley | 60/39.23 X |
| 3,203,177 | 8/1965 | Johnson | 60/39.25 X |
| 3,255,586 | 6/1966 | Hennig | 60/39.27 X |
| 3,418,806 | 12/1968 | Wagner | 60/39.29 X |
| 3,584,459 | 6/1971 | Amann | 60/39.29 X |

*Primary Examiner*—Clarence R. Gordon

[57] ABSTRACT

A method and apparatus for preventing overspeed in a gas turbine in response to the rapid loss of applied load is disclosed. The method involves diverting gas from the inlet of the turbine, bypassing the same around the turbine and thereafter injecting the diverted gas at the turbine exit in a direction toward or opposing the flow of gas through the turbine. The injected gas is mixed with the gas exiting the turbine to thereby minimize the thermal shock upon equipment downstream of the turbine exit.

8 Claims, 3 Drawing Figures

METHOD AND APPARATUS FOR PREVENTING OVERSPEED IN A GAS TURBINE

This invention was made in the course of a contract with the Energy Research and Development Administration, ERDA Contract No. E(04—3)-167, Project Agreement No. 46.

The present invention generally relates to gas turbines and, more specifically, to a method and apparatus for preventing overspeed in a gas turbine.

The sudden removal of the load applied to a gas turbine typically produces a rapid overspeed condition for the turbine which may rapidly generate critical stresses on the equipment. This is particularly true for relatively large gas turbines of the type used in the commercial generation of electric power, since such turbines are connected to a heat source that may be quite slow in responding to a change in output. With loss of load heat in the gas is not removed by work in the turbine so the gas leaving the turbine is hotter than in normal operation. Since the gas turbines used in the generation of electricity are typically quite large and expensive, a reliable means for controlling overspeed is necessary for the protection of the turbine, or, alternatively, the turbine must be designed to withstand a possible overspeed condition for a limited time without substantial damage. Since designing a turbine to withstand such an overspeed condition involves a substantial additional expense in a normally sophisticated and expensive piece of equipment, other apparatus of some type is usually incorporated in an overall system for limiting an overspeed condition. Prior art apparatus that have been used to prevent a dangerous overspeed condition due to a sudden loss of load have usually bypassed the gas from the exit of the compressor to the exit of the turbine, or throttled the gas flow to the turbine. The apparatus for bypassing has typically included a bypass duct with suitable valves to control the flow therethrough. When the gas is diverted from the compressor exit and is reintroduced at the turbine exit, it bypasses the heat source and is therefore much cooler than the gas that is not bypassed. The significantly cooler gas temperature can provide a thermal shock to any equipment downstream of the turbine and the effects of such a thermal shock can by quite damaging. If the bypassed gas is merely injected at the turbine exit, the phenomenon of heat streaking will also be present if the hot and cool gaseous streams are not suitably mixed together, and this condition is aggravated by the fact that the turbine exit gas is hotter than during normal operation.

The increased temperature of the turbine exit gas is not affected by merely throttling the gas flow to the turbine.

Accordingly, it is an object of the present invention to provide a method and apparatus for effectively preventing a potentially damaging overspeed condition in a turbine due to the sudden loss of load, while substantially minimizing the potentially damaging effects of thermal shock and temperature streaking to any equipment that is located downstream of the turbine.

Other objects and advantages will become apparent upon reading the following detailed description, while referring to the attached drawings, in which.

Figure 1:
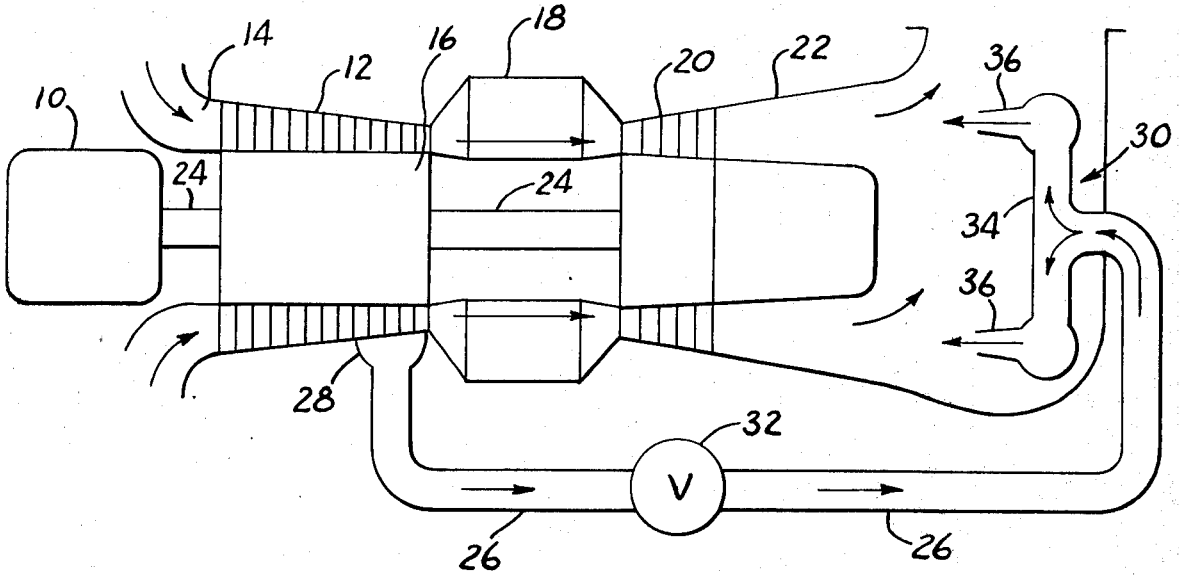
FIG. 1 is a schematic diagram of a gas turbine in a working environment, and illustrating apparatus embodying the present invention in idealized form.

Turning now to the drawings, particularly to the idealized schematic of FIG. 1 which illustrates apparatus embodying the present invention shown in conjunction with a turbine, turbine diffuser, heat source, compressor and load, all of which may be present in a generating system having a nuclear or fossil fuel fired heat source. More specifically with respect to the schematic illustration of FIG. 1, there is shown a load 10, a compressor 12 having an inlet 14 and an outlet 16 which is in communication with a heat source 18. The heat source is, in turn, operably connected to a turbine 20 and turbine diffuser 22, with the turbine, compressor and load being interconnected by a shaft 24.

During normal operation, gas enters the inlet 14 of the compressor where the gas pressure is increased before being fed to the heat source 18 which heats the gas and causes it to rapidly expand and drive the turbine 20. It should be understood that the blades of the turbine as well as those of the compressor are not shown in detail. The energy produced by the turbine drives the compressor as well as the load 10 which is an electrical generator or the like. The exhaust from the turbine 20 is expelled through the diffuser 22 and is thereafter recirculated through the system. It should also be understood that equipment located downstream from the diffuser 22 may include heat exchangers, recuperators or other equipment.

As previously mentioned, the sudden loss of the load may cause the speed of the turbine to rapidly increase which could severely damage it in the event compensating changes were not made. Since a nuclear heat source is relatively slow in responding to a control adjustment which reduces its heat output, the overspeed condition of the turbine must be compensated for by other extended controls. As previously mentioned, current practive has involved diverting gas from the compressor and reintroducing the gas downstream of the turbine, in effect bypassing the heat source. While the bypassing effectively reduces the overspeed condition of the turbine, the introduction of the cooler compressor exit gas at the turbine exit can have severe consequences to equipment located downstream of the turbine. In this regard it should be understood that the temperature of the gas bypassed around the turbine will be considerably cooler because the gas is merely bypassed around the heat source. Moreover, if the turbine overspeed is prevented by merely throttling down the turbine, an appreciable increase in the turbine exit gas temperature will result, since the heat from the heat source will not be carried away by work being done in the turbine. The occurrence of a rapid change in temperature from either of these conditions can drastically affect the downstream equipment. If the bypassed gas is injected upstream into the turbine exit it effectively throttles the turbine exit gas flow. The turbine exit gas flow is also cooled by mixing with the bypassed gas. By correct proportioning of the bypass flow rate and the upstream injection arrangement, the mixed gas temperature can be arranged to be equal within limits to the turbine exit gas temperature before the loss of load occurred. This prevents thermal shock to equipment downstream of the turbine and the turbine is prevented from overspeeding by the combined effects of throttling the flow through the turbine and bypassing gas around the turbine.

In accordance with an important aspect of the present invention, a bypass duct 26 is provided which has an inlet 28 communicating with the outlet 16 of the compressor and outlet means, indicated generally at 30, located downstream of the turbine diffuser 22. A valve 32 is provided to control the flow of gas through the duct 26. The outlet means 30 is adapted to direct the flow of the bypassed gas upstream toward the turbine diffuser and to distribute the flow generally uniformly around the circumference of the diffuser rather than injected in one location. To achieve this uniform distribution, the outlet means 30 comprises a feeder manifold 34 which has a generally circular configuration as viewed from the end and a number of nozzles 36 spaced around the manifold adapted to direct by bypassed gas in opposition to the flow of gas through the turbine and the turbine diffuser.

Figure 2:
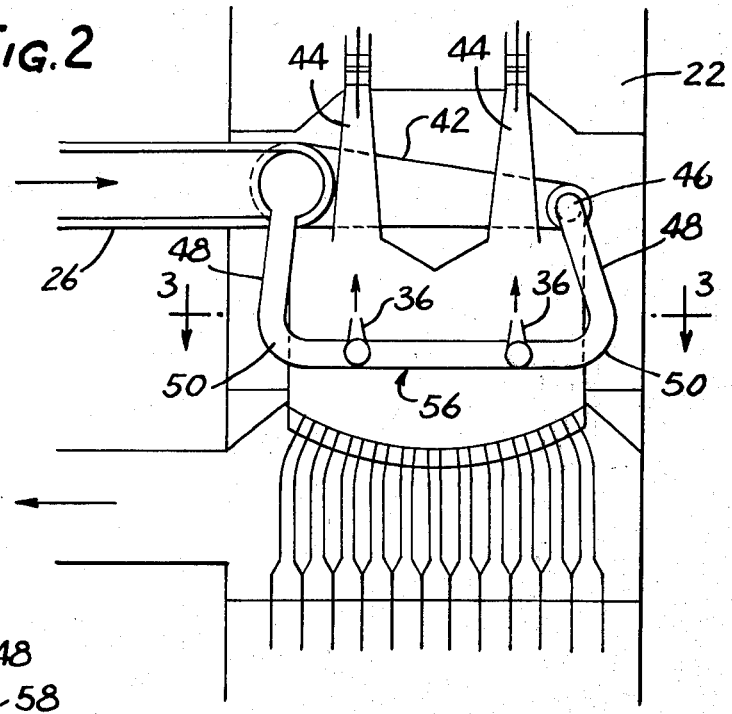
FIG. 2 is a cross section view of a simplified and idealized turbine together with portions of apparatus embodying the present invention.
Figure 3:
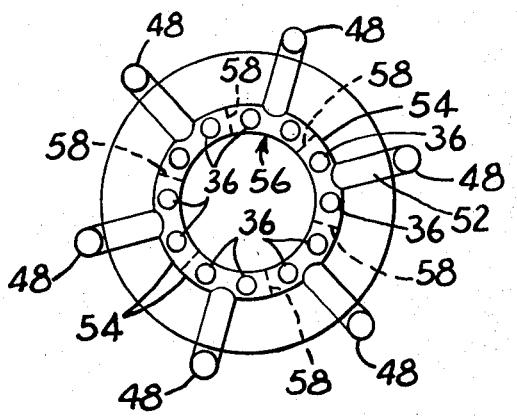
FIG. 3 is an end view of a portion of the apparatus embodying the present invention taken generally in the direction of the line 3—3 of FIG. 2.

Referring to the more detailed schematic illustrations of FIGS. 2 and 3, a duct 26 connected to the valve 32 (not shown) feeds the diverted flow of gas to a manifold 42 which extends around the circumference of the diffuser 22, preferably outside of the main flow of gas that exits through an annular passage 44. The duct 26 intercepts the manifold 42 and the flow is diverted in two directions. The inside diameter of the manifold at the point of the intersection with the duct 26 is shown to be larger than the portion 46 located on the diametrically opposite side. Thus, the size of the manifold gradually decreases the greater the distance around the manifold from the duct 26.

To inject the bypassed gas into the flow of gas exiting diffuser in the passage 44, a number of branch ducts 48 are connected to the manifold 42 at predetermined locations as shown. It is preferred that the ducts 48 do not impede the flow of gas from the passage 44 and that interference be minimized and, to this end, the portion of each of the ducts 48 that extends parallel to the flow is preferably located outside of the flow. As shown in FIGS. 2 and 3, each of the ducts 48 have bend 50 and a portion 52 that extends radially inwardly and terminates in an arcuate portion 54 which, together with all other arcuate portions, form an annular ring indicated generally at 56. Since the flow of gas from the turbine may be substantial and the temperature quite high, the structural rigidity offered by the unitary annular ring 56 is quite desirable. However, the flow of gas through each of the ducts 48 does not merge with the arcuate portion 54 of the adjacent ducts because of internal barrier walls 58 which isolate the arcuate portions from one another. Each of the arcuate portions 54 have a pair of nozzles 36 attached thereto which are adapted to direct the gas upstream into the channel 44 opposing the exhaust gas from the turbine and turbine diffuser. As shown in FIG. 3 there are a total of twelve nozzles that are located around the annular ring 56 which are operable to provide a generally uniform distribution of the diverted gas upstream toward the turbine diffuser.

The uniform upstream injection of the bypassed gas opposing the flow of the exhaust gas of the turbine diffuser 22 has the effect of providing a mixing action which mixes the relatively cool bypassed gas with the substantially hotter turbine exhaust so that the temperature of the resulting mixed gas is not appreciably affected. Since the injection of the bypassed gas is upstream rather than downstream, temperature streaking is also substantially reduced if not eliminated and the detrimental effects of such streaking are also necessarily reduced. The upstream injection also tends to throttle down the turbine flow which also helps to prevent turbine overspeed. Moreover, the upstream injection may reduce the size requirements of the bypass valve and bypass duct 26 as compared to prior art practices, because of the advantage of throttling down of the turbine flow.

From the foregoing description, it should be understood that an improved method and apparatus of preventing overspeed of a gas turbine has been shown and described. The present invention protects a turbine from damage due to an overspeed condition caused by the sudden reduction in load and is effective to protect the turbine for the time required to adjust the output of the heat source. The present invention is effective in substantially minimizing damage of equipment such as recuperators and heat exchangers from thermal shock and temperature streaking that have been experienced with prior art apparatus.

It should be understood that although preferred embodiments of the present invention have been illustrated and described, various modifications thereof will become apparent to those skilled in the art and, accordingly, the scope of the present invention should be defined only by the appended claims and equivalents thereof.

What is claimed is:

1. A method of preventing overspeed in a gas turbine in response to a rapid decrease in the load applied thereto, the input of said gas turbine being operably associated with a compressor, a main flow of gas passing through said compressor and turbine, the method comprising the steps of:

diverting from the main flow of gas a stream of gas from the exit of said compressor;

bypassing said turbine input with said diverted stream;

injecting said diverted stream downstream of the turbine exit; and, directing said injected stream upstream toward said turbine exit to thereby reduce the flow of gas through the turbine and minimize overspeed therein, while mixing the bypassed and injected stream with the main flow of gas from the turbine exit to reduce thermal shock downstream of the turbine exit.

2. A method as defined in claim 1 wherein said diverted stream is injected upstream toward said turbine exit by a plurality of nozzles located adjacent said turbine exit and directed toward said turbine exit.

3. A method as defined in claim 2 wherein said nozzles are located generally circumferentially around said turbine exit so as to provide a mixing action of the injected gas with the gas exiting said turbine.

4. A method of protecting a gas turbine from overspeed caused by rapid loss of applied load, said turbine operating in a system having a compressor connected upstream of the turbine input, the method comprising the steps of:

bypassing a portion of the main gaseous stream from the compressor output and diverting the same from said turbine input;

injecting said diverted stream into the main stream near the turbine exit in a direction upstream toward said turbine exit to thereby reduce the flow of gas through the turbine and minimize overspeed of said turbine, while mixing the bypassed gas with the gas from the turbine exit to reduce thermal shock downstream of said turbine exit.

5. A method as defined in claim 4 wherein a number of nozzles are positioned to inject said diverted stream upstream into said turbine exit.

6. A method as defined in claim 4 wherein a valve means controls the magnitude of the portion of gas flow that is bypassed from the compressor output.

7. Apparatus for preventing overspeed of a gas turbine having an inlet and exit with a flow of gas therethrough, the turbine having its inlet in operable relation with the exit of a compressor, comprising, in combination:

bypass duct means having an inlet positioned to intercept and divert gas flowing toward the inlet of the turbine from the compressor;

valve means for controlling the flow of fluid through said bypass duct means;

distribution means connected to the downstream end of said bypass duct means and adapted to distribute the diverted gas flow generally uniformly across a predetermined area adjacent said turbine exit, said distribution means also being adapted to direct said diverted gas in a direction upstream toward said turbine exit to oppose the flow and thereby mix the diverted gas with the gas flow through said turbine, said mixing being effective to minimize heat streaking downstream thereof.

8. Apparatus as defined in claim 7 wherein said distribution means extends generally around the circumference and outside of the main gas flow through said turbine, and includes a number of branch ducts in communication therewith, said branch ducts extending into the main flow and supporting a number of nozzles adapted to direct said diverted gas toward said turbine exit.

* * * * *